US006119738A

United States Patent [19]

Idol

[11] Patent Number: 6,119,738

[45] Date of Patent: Sep. 19, 2000

[54] INFLATING DEVICE

[76] Inventor: Michael P. Idol, 410 Cameronden Ct., Kernersville, N.C. 27284

[21] Appl. No.: 09/434,547

[22] Filed: Nov. 8, 1999

[51] Int. Cl.[7] ..... B65B 3/16

[52] U.S. Cl. ..... 141/114; 141/50; 141/67; 141/197; 141/388; 239/525; 239/DIG. 22

[58] Field of Search ..... 141/38–40, 44, 141/47, 50, 67, 68, 114, 197, 313, 317, 349, 388; 239/525, DIG. 22; 273/458; 417/568; 446/220

[56] References Cited

U.S. PATENT DOCUMENTS 3,368,742 2/1968 La Plante et al. ..... 230/17
3,994,324 11/1976 Zeyra ..... 141/349
4,921,402 5/1990 Nelson et al. ..... 415/148
5,324,045 6/1994 Trawick et al. ..... 273/458
5,566,728 10/1996 Lange ..... 141/10

*Primary Examiner*—Henry J. Recla
*Assistant Examiner*—Timothy L. Maust

[57] ABSTRACT

An inflating device having an air pressure generator for generating air flow and an air flow directing member connected to the air pressure generator. The air flow directing member has an inflating air flow nozzle extending therefrom and a surplus air flow exhaust enabling the exhausting of noninflating air to the atmosphere from the air pressure generator.

1 Claim, 5 Drawing Sheets

INFLATING DEVICE

BACKGROUND OF THE INVENTION

1. Field of the Invention

The present invention relates generally to inflating devices and more particularly to an inflating device formed from a leaf blowing apparatus having an air flow nozzle and a surplus air flow exhaust to enable the utilization of generated air flow.

2. Description of the Prior Art

Inflatable objects are conventionally enabled by air compressors or pumps, either automatic or manual. While these work fine for smaller inflatable objects, they are usually insufficient in power and air flow volume to work on inflatable objects of more than small size. In that event other industrial type air compressors are required to furnish the power and volume of air flow necessary to fully inflate a sizable object. Examples of such devices are disclosed in U.S. Pat. Nos. 5,584,505; and 5,678,857.

As can be seen, the industrial compressor devices and those listed above are rather complex in design and construction and are very expensive to purchase and maintain. It is desirable to have a simply constructed and relatively inexpensive mechanism to handle large inflatable objects, and it is to that need that the present invention is directed.

OBJECTIVES AND SUMMARY OF THE INVENTION

It is a principal objective of the present invention to provide an inflating device that encompasses all of the benefits of prior art devices and more and contains none of the deficiencies of such devices.

A further objective of the present invention is to provide an apparatus of the type described that is simple in construction and operation far less expensive than conventional devices.

Yet another objective of the present invention is to provide an apparatus of the type described which can be made from existing inexpensive high volume air flow devices.

From the foregoing objectives, it can be seen that the present invention is an inflating device utilizing an air pressure generator such as a leaf blower capable of generating high air flow velocity and volume. An air flow directing device is connected to the air pressure generator and thus provides means for carrying air flow in a given pattern and direction. The air flow directing device includes a tubular member having first and second tubular sections, one or both of which may taper, the second tubular section being smaller than the first tubular section and connected thereto by a circular vertical junction joining the large end of the second tapering tubular section with the small end of the first tapering tubular section and forming an exhaust exit for surplus air flow. A flexible air flow extension attaches to the small end of the second tubular section for direct connection to the object to be inflated.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. It is to be understood that the invention is not limited in its arrangement of the components set forth in the description and illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is also to be understood that the abstract is neither intended to define the invention of the application, which is measured by the claims, nor to limit its scope in any way.

Thus, the enumerated objectives and others identified herein, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive material in which like characters of reference designate like parts throughout the several views.

DETAILED DESCRIPTION OF PREFERRED EMBODIMENT

Figure 1:
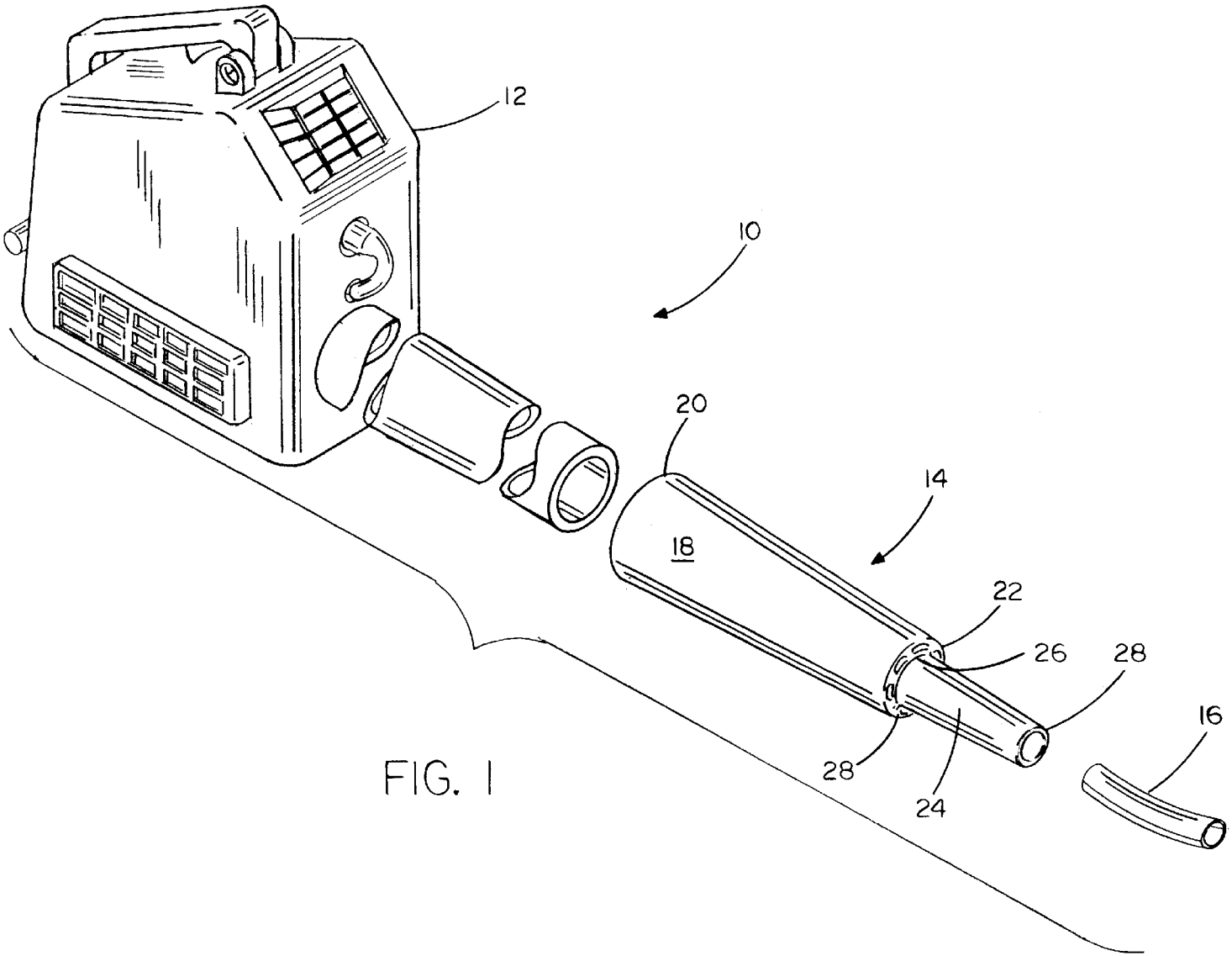
FIG. 1 is a perspective and exploded view of a first embodiment of the inflating device comprising the present invention showing the air flow member, the air flow directing member, an air flow extension, and a leaf blower forming the air flow generator for the inflating device.
Figure 2:
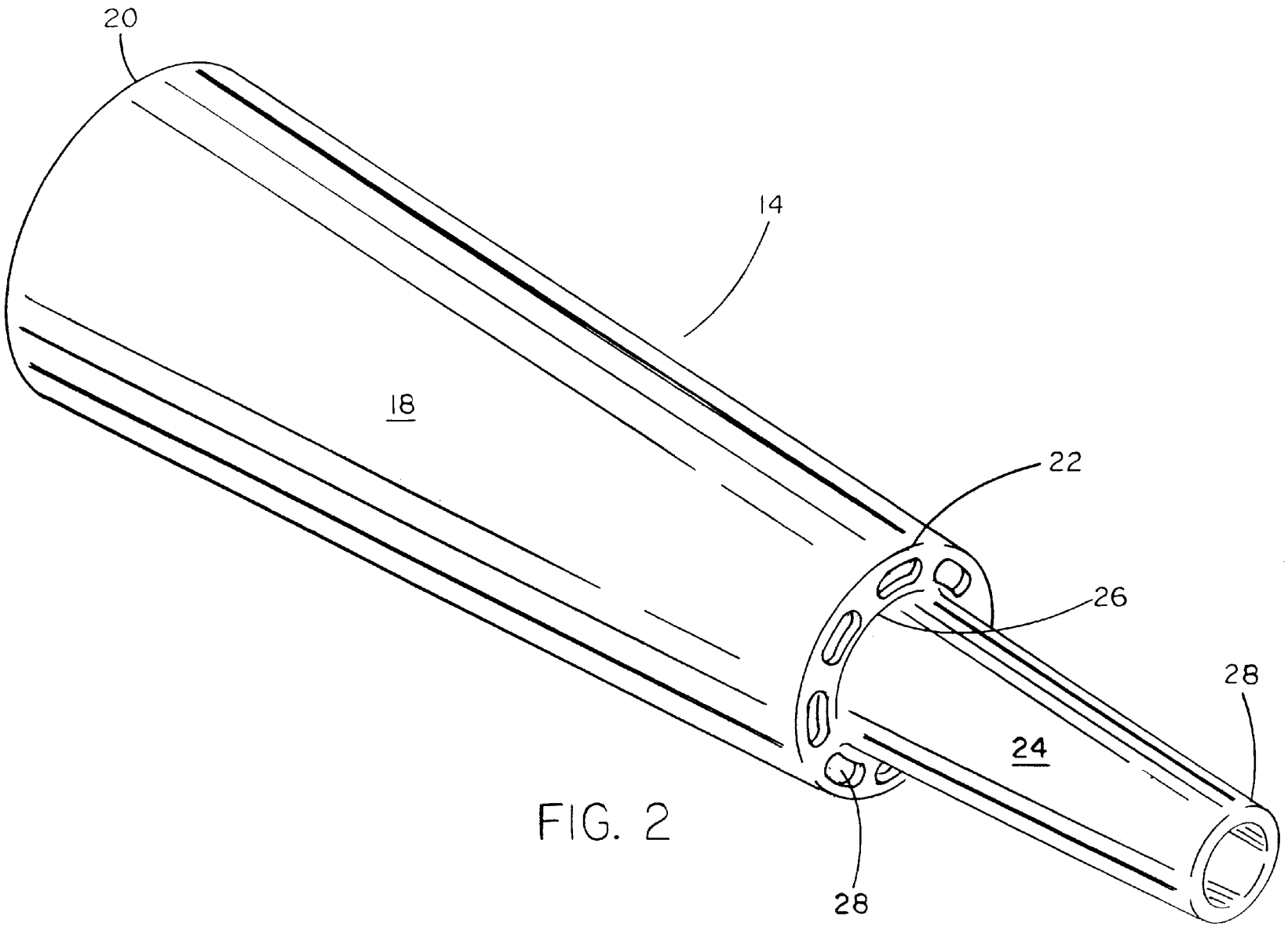
FIG. 2 is a perspective view of the air flow directing member of the present invention.
Figure 5:
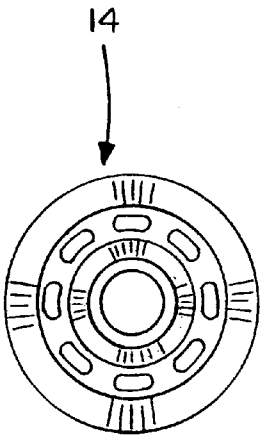
FIG. 5 is a end elevational view of the air flow directing device shown in FIGS. 2–4.

Referring now to the drawings and particularly to FIG. 1, a first embodiment of the inflating device of the present invention is shown generally as 10 and includes an air flow generator 12 shown in FIG. 1 as a leaf blower and referred hereinafter by that designation for convenience, along with an air flow directing member shown generally as 14. An air flow directing member extension 16 is removably attachable to air flow directing member 14 by a frictional or connector aided (not shown) attachment thereto.

Air flow device 14 has a first tapering tubular member 18 extending from a large end 20 to a smaller end 22. Device 14 has a second tapering tubular section 24, it too having a large end 26 and a smaller end 28. Small end 22 of section 18 joins large end 26 of section 24 to form a junction and grill 28 that provides an opening for exhausting surplus air flow. Surplus air flow is the additional air flow not needed to inflate the device being inflated and thus is allowed to escape to the atmosphere.

Figure 3:
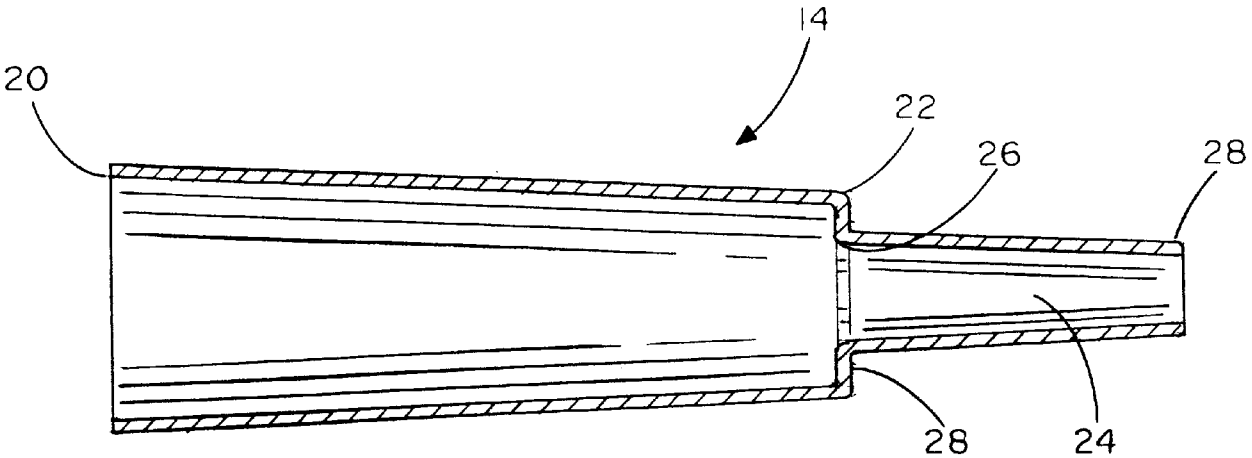
FIG. 3 is a plan view of the air flow directing device shown in FIG. 2.
Figure 4:
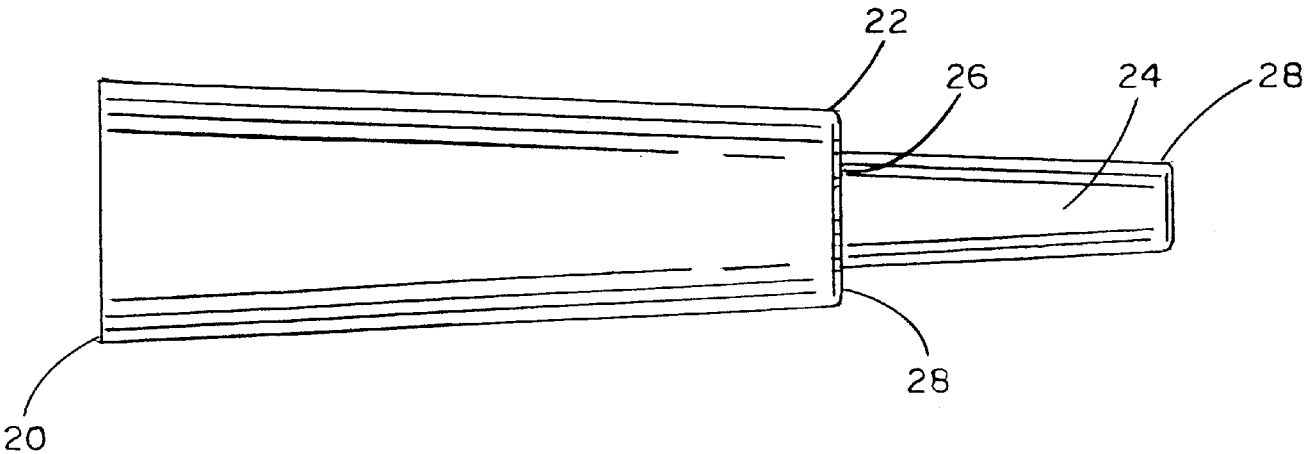
FIG. 4 is a side elevational view of the air flow directing device shown in FIGS. 2 and 3.
Figure 7:
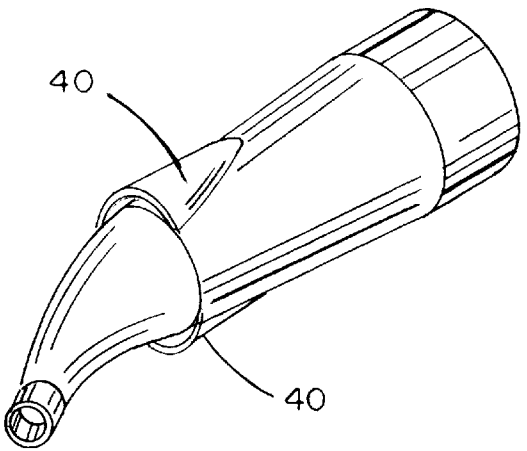
FIG. 7 is a perspective view of the second section of the air flow directing member and extension of the embodiment shown in FIG. 6.

Air flow directing device 14 can be formed of two separate sections 18, 24 or it can be integral in construction as shown in FIG. 3 where sections 18, 24 are molded together to form a single integral section with the openings for grill 28 predisposed within the molded section by appropriate means associated with the mold itself.

Extension 16 can be of any convenient dimension and length; i.e., different diameters and lengths, to fit the inflatable receiving member of any object to be inflated.

Figure 6:
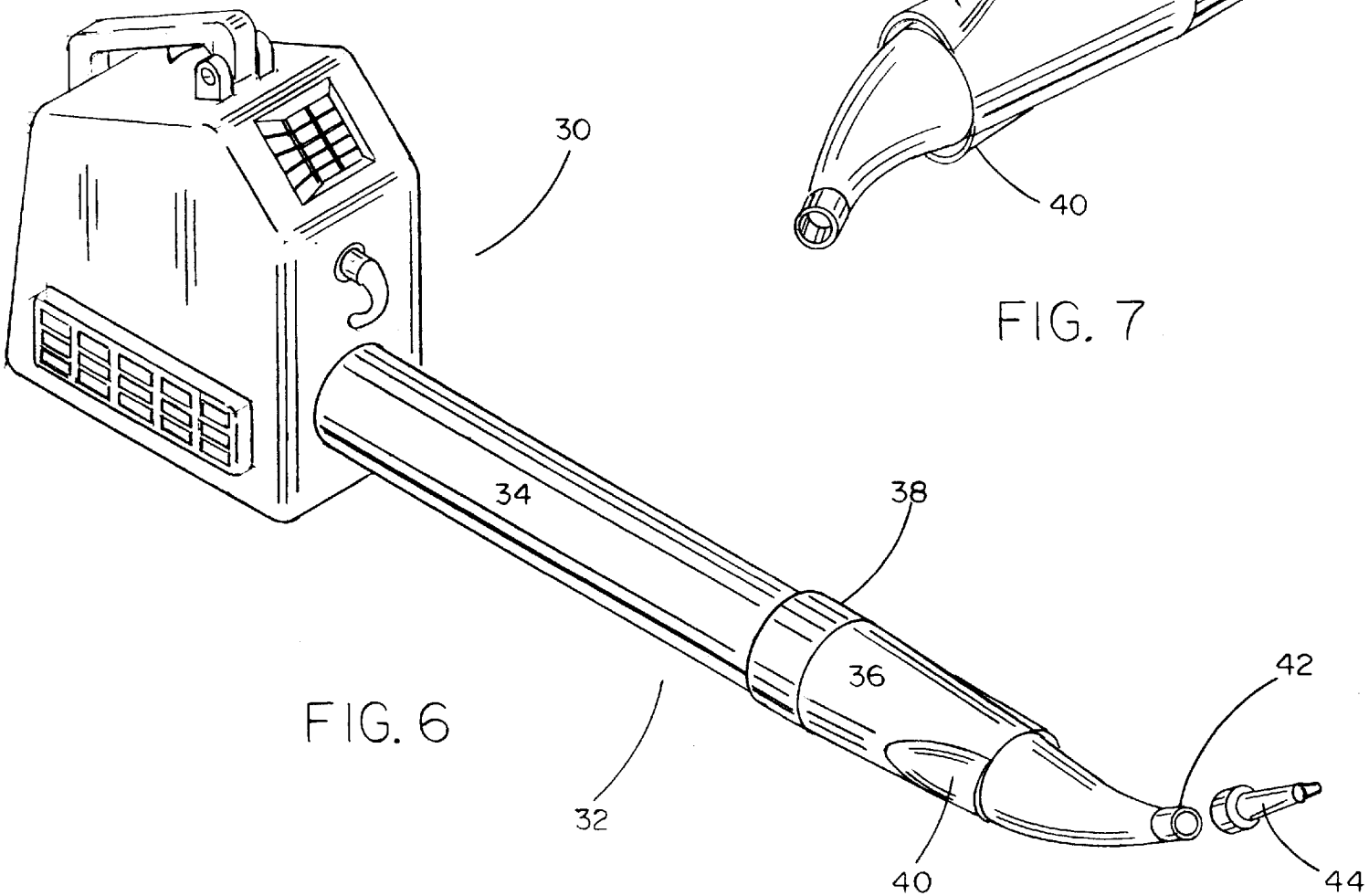
FIG. 6 is a perspective and exploded view of a second embodiment of the inflating device comprising the present invention showing the air flow directing member, the air flow directing member extension and a leaf blower forming the air flow generator for the inflating device.
Figure 8:
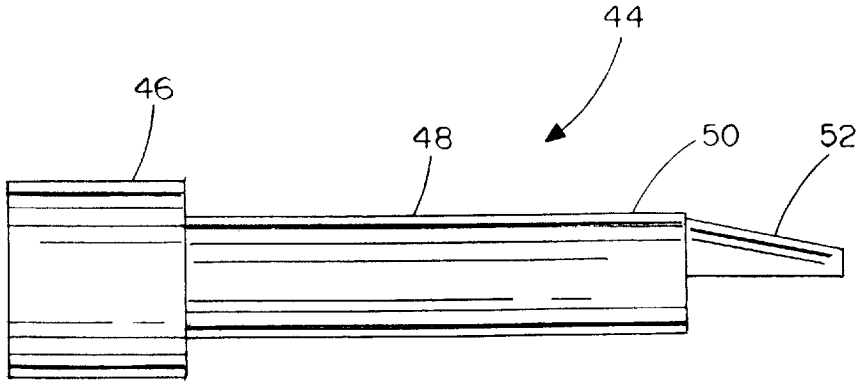
FIG. 8 is an enlarged, side elevational and sectional view of the air flow directing member extension of the embodiment shown in FIGS. 6 and 7.
Figure 9:
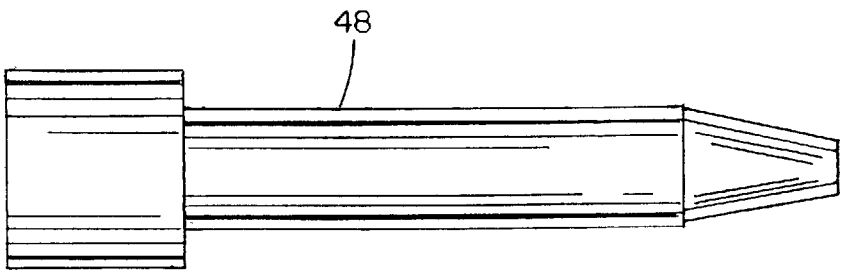
FIG. 9 is an enlarged, top plan and sectional view of the air flow directing member extension shown in FIG. 8.
Figure 10:
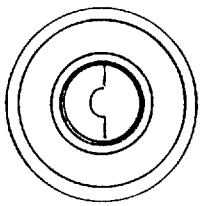
FIG. 10 is an end elevational view of the air flow directing member extension shown in FIGS. 8 and 9.

The second embodiment of the present invention is shown generally as 30 in FIG. 6 which differs in the formation of the air flow device shown generally as 32. Air flow device 32 has a first tubular member 34 of uniform diameter and a second tapering tubular member 36 which is separate from member 34 but cooperatively connects therewith. The large end 38 either frictionally engages outer end of member 34 or is formed by a connecting band functional to secure members 34 and 36 to each other in and end-to-end relationship.

Member 36 has diametrically opposed exhausts 40 which provide openings for exhausting surplus air flow. End 42 of member 36 is preferably slightly curved to provide ease in operation, however the last small length of end portion 42 is of uniform diameter to attach within an air flow directing member extension 44.

Extension 44 has a connector hub 46 for receiving end 42 of member 36. Hub 46 is secured to tapering tip 48 which has at its outer end 50 a half nozzle 52 designed in this manner to more easily insert into a device to be inflated. Obviously, tapering extension 48 could be flexibly constructed to provide a wider range of motion to the inflating end of device 30.

In operation, leaf blower 12 is activated and a large volume of generated air flows into larger end 20 of section 18, section 24, extension 16 and into the object to be inflated. The surplus air flow, not required to inflate the object, escapes through grill 28 in a uniform and even circular flow pattern thus dispersing harmlessly into the atmosphere. Embodiment 30 operates in a similar manner with the surplus air flow escaping through exhausts 40.

Thus an embodiment of the inflating mechanism has been illustrated and described in operable form. It is to be realized that optimum dimensional relationships for the parts of the invention to include variations in size, materials, shape, form, function and manner of operation, assembly and use are deemed readily apparent and obvious to one skilled in the art. All equivalent relationships to those illustrated in the drawings and described in the specification are intended to be encompassed herein. The foregoing is considered as illustrative only of the principles of the invention. Numerous modifications and changes will readily occur to those skilled in the art, and it is not desired to limit the invention to the exact construction and operation shown and described. All suitable modification and equivalents that fall within the scope of the appended claims are deemed within the present inventive concept.

What is claimed is:

1. An inflating mechanism comprising: means for providing air pressure and thereby generating air flow; air flow directing means connected to the air pressure providing means having an inflating air flow nozzle and surplus air flow exhaust means enabling the exhaust of noninflating air to the atmosphere from the air pressure providing means; an inflating air flow extension connected to the inflating air flow nozzle, the air flow extension having a tapering tip with first and second ends, a hub at the first tapering tip end, and a half nozzle at the second tapering tip end wherein the air flow extension is flexible and the air flow directing means includes a tubular member having first and second tubular sections, the second tubular section tapering downwardly and arcuately away from the first tubular section to a smaller diameter and having openings communicating therewith forming the exhaust exit for the surplus air flow exhaust means.

* * * * *